US005680993A

United States Patent [19]

McCracken et al.

[11] Patent Number: 5,680,993

[45] Date of Patent: Oct. 28, 1997

[54] LIQUID ATOMIZING DEVICE WITH CONTROLLED ATOMIZATION AND SPRAY DISPERSION

[75] Inventors: Thomas W. McCracken; Kevin A. Jonasson, both of Orleans; Adam J. Bennett, Ottawa, all of Canada

[73] Assignee: National Research Council of Canada, Ottawa, Canada

[21] Appl. No.: 464,952

[22] Filed: Jun. 5, 1995

[51] Int. Cl.[6] ..... B05B 7/00

[52] U.S. Cl. ..... 239/433; 239/434; 239/547; 239/DIG. 7

[58] Field of Search ..... 239/290, 433, 239/434, 455, 318, 545, 547, DIG. 7, 550, 151, 172, 77, 601; 222/575

[56] References Cited

U.S. PATENT DOCUMENTS

| | | | |
|---|---|---|---|
| 3,164,324 | 1/1965 | Bruinsma | 239/77 |
| 3,252,656 | 5/1966 | Greenwood | 239/77 |
| 3,472,454 | 10/1969 | Blue et al. | 239/77 |
| 3,625,426 | 12/1971 | Swanson | 239/77 |
| 4,349,153 | 9/1982 | Johnson | 239/65 |
| 4,504,014 | 3/1985 | Leuning | 239/438 |
| 4,673,132 | 6/1987 | Inculet et al. | 239/77 |
| 4,927,080 | 5/1990 | Alsing | 239/172 |
| 5,102,051 | 4/1992 | Smith et al. | 239/297 |
| 5,152,460 | 10/1992 | Barty | 239/290 |
| 5,165,605 | 11/1992 | Morita et al. | 239/296 |
| 5,176,322 | 1/1993 | Sartor | 239/77 |
| 5,402,945 | 4/1995 | Swanson, Jr. | 239/172 |

FOREIGN PATENT DOCUMENTS

| | | | |
|---|---|---|---|
| 1238020 | 6/1988 | Canada | 222/34 |
| 915224 | 10/1946 | France . | |
| 2079514 | 11/1971 | France . | |
| 2129711 | 5/1984 | United Kingdom . | |
| WO87/00078 | 1/1987 | WIPO . | |
| WO87/01909 | 4/1987 | WIPO . | |

*Primary Examiner*—Andres Kashnikow
*Assistant Examiner*—Lisa Ann Douglas
*Attorney, Agent, or Firm*—H. Wayne Rock

[57] ABSTRACT

An atomizing nozzle primarily designed for agricultural spraying has a narrow and controlled droplet size distribution and the ability to shape the spray into a solid cone or fan for evenly applying the spray to the crops. The nozzle is able to operate at low air delivery pressures, in the order of 10 to 30 in. of water column. A central air delivery bore communicates with an air manifold within a boom. Near the exit plane of the throat there is provided an inlet conduit connected to the liquid to be sprayed, the conduit being at right angles to the bore axis. An outlet nozzle from the conduit is positioned on the bore axis and has its exit plane upstream of the exit plane of the bore so that atomization of the liquid will take place within the central bore between the two exit planes. A pair of shaping nozzles are connected to secondary bores that in turn communicate with the manifold. The shaping nozzles are directed orthogonally to the central bore axis and to the inlet conduit and are located downstream of the exit plane of the central bore. The jets issuing from the shaping nozzles shape the cone-shaped spray into a generally fan-shaped configuration. Because the shaping jets are always at the same pressure as the atomization air the dispersion of the droplets exiting the nozzle will be consistent and the spray pattern will be constant over the operating pressure range of the apparatus.

16 Claims, 2 Drawing Sheets

LIQUID ATOMIZING DEVICE WITH CONTROLLED ATOMIZATION AND SPRAY DISPERSION

The present invention relates to nozzles in general and in particular to atomizing nozzles utilized in agricultural spray equipment.

BACKGROUND OF THE INVENTION

It is common to spray a variety of liquid chemicals on field grown crops in order to enhance the growth thereof or to inhibit destruction of the crops by insects or other pests. With some types of chemical fertilizers or pesticides it is desirable to carry the spray to the underside of the plant leaves for optimum effectiveness. When spraying the liquid onto the plants it is well known to utilize air shear spraying equipment which involves a long hollow boom which is connected to a source of air under pressure, the boom being provided with a series of spaced apart nozzles therein. Each nozzle is supplied with liquid under pressure, which liquid is mixed with air from the boom so that the liquid is atomized at the exit from the nozzle. The pressurized air from the boom carries the liquid as a cone-shaped spray towards the plant. Additional nozzles at the exit from the nozzle have been used to shape the cone-shaped spray into a more fan-shaped configuration.

Present agricultural spray technology does not provide an optimized application of liquid, whether herbicide or pesticide, with an air shear device which is characterized by a controlled droplet size distribution and a well-defined liquid patternation. Droplet size is an issue in that too fine a spray will result in off-target drift and too coarse a spray will result in poor spray efficacy. In order to maximize target contact the atomizer must have an even velocity profile.

An air shear spray device is disclosed in U.S. Pat. No. 4,504,014. The system of that patent has demonstrated the benefits of improved spray delivery by significantly increasing weed and pest control. The atomizer design of that patent, however, limits any decrease in chemical usage, or improvement in operational range and spray efficacy. Simultaneous control of droplet size distribution and spray pattern over the desired operational range is not achieved with the design of that patent.

The hydraulic sprays generated by traditional fan jet equipment produce spray characterised by large droplets with relatively slow delivery velocities and thus require significantly larger application rates to effect the same crop control as contact with the target plants is not efficient. Air assisted spray systems that make use of controlled air delivery to accelerate the liquid spray to the target leaf canopy are also limited by the performance of hydraulic nozzles. Air shear systems are limited in performance by the atomization mechanism associated with inconsistent liquid filming and poor control of the aerodynamic shear environment associated with the droplet breakup mechanism.

There is therefore a need for a better atomizer for agricultural spray systems which will provide a controlled or limited droplet size distribution to avoid poor efficacy due to droplets that are too large, or drifting or off-target delivery due to droplets that are too small.

SUMMARY OF THE INVENTION

The present invention overcomes the problems associated with the prior art agricultural spray systems by providing an atomizing nozzle that has a narrow and controlled droplet size distribution and the ability to shape the spray into a solid cone or fan that can evenly apply the spray to the crops. The nozzle of the present invention is able to operate at low air delivery pressures, in the order of 10 to 30 in. of water column. The simple design has a central air delivery bore or throat communicating with an air manifold within the boom. Near the exit plane of the bore there is provided an inlet conduit connected to a source of the liquid to be sprayed, the conduit being at right angles to the bore axis. An outlet nozzle from the conduit is positioned on the axis of the central bore and has its exit plane upstream of the exit plane of the bore so that atomization of the liquid will take place within the central bore between the two exit planes. A pair of shaping nozzles are connected to secondary bores that in turn communicate with the manifold. The shaping nozzles are directed orthogonally to the central bore axis as well as to the inlet conduit and are located downstream of the exit plane of the central bore. The jets issuing from the shaping nozzles shape the cone-shaped spray into a generally fan-shaped configuration. Because the shaping jets are always at the same pressure as the atomization air the dispersion of the droplets exiting the nozzle will be consistent and the spray pattern will be constant over the operating pressure range of the apparatus, thereby avoiding the problems of the prior art.

Broadly speaking, therefore, the present invention may be considered as providing a device for atomizing a liquid at low pressures comprising:

- a nozzle body adapted for mounting to a manifold supplied with pressurized air;
- a central bore in the nozzle body communicating at one end with the manifold and extending in a downstream direction to an exit plane at the other end;
- an inlet conduit for the liquid, the conduit extending through the nozzle body into the bore at right angles thereto upstream of the exit plane, the inlet conduit being adapted for connection to a source of the liquid to be sprayed;
- an outlet nozzle for the liquid, the outlet nozzle being aligned with the axis, extending downstream from the inlet conduit, and terminating at an exit plane located upstream of the central bore exit plane; and
- a pair of diametrically opposed shaping nozzles positioned downstream of the central bore exit plane and extending orthogonally to the central bore axis and to the inlet conduit, each shaping nozzle being connected to a secondary bore in the nozzle body, each secondary bore communicating the shaping nozzle with the manifold;
- whereby liquid fed under pressure to the inlet conduit exits the outlet nozzle and is atomized between the exit planes of the outlet nozzle and the central bore as it is mixed with air flowing along the central bore, air exiting the opposed shaping nozzles serving to shape the atomized liquid spray into a flattened fan shape.

BRIEF DESCRIPTION OF THE INVENTION

DESCRIPTION OF THE PREFERRED EMBODIMENT

Figure 1:
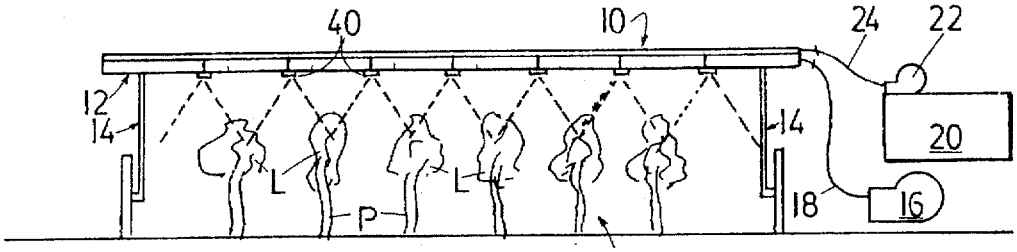
FIG. 1 shows schematically a particular application for the present invention.
Figure 2:
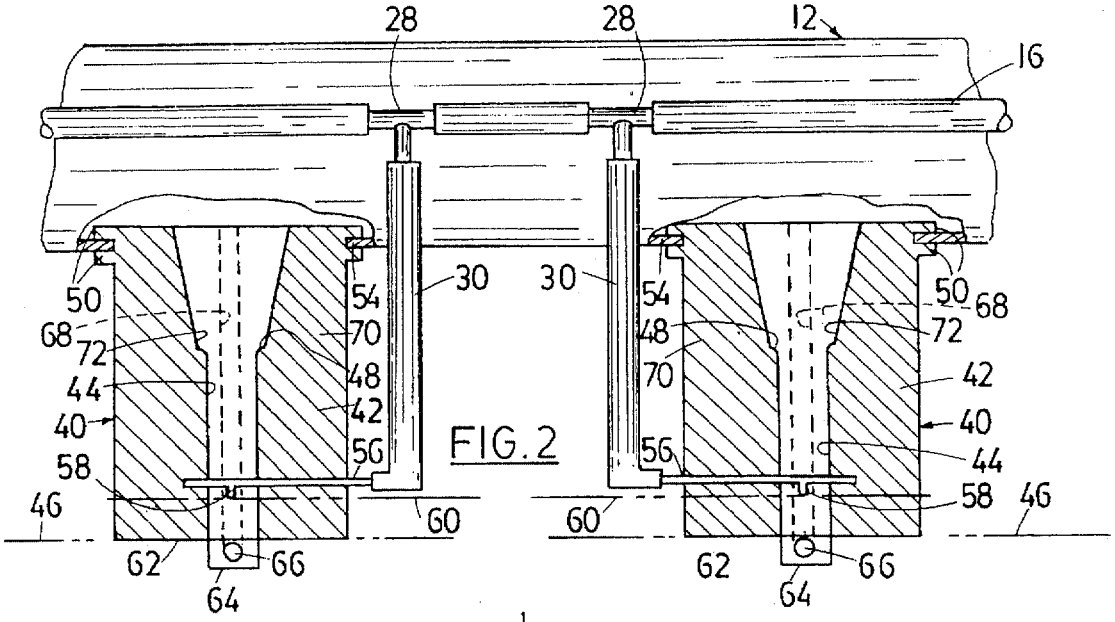
FIG. 2 shows in partial section a spray boom having atomizing nozzles of the present invention incorporated therein.
Figure 3:
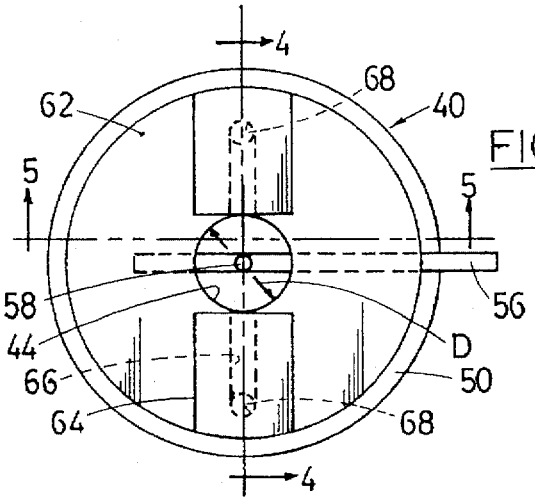
FIG. 3 is a somewhat enlarged front end view of the atomizing nozzle of the present invention.

FIG. 1 shows generally an application for the atomizing nozzle of the present invention. A growing crop C is illustrated, the crop including a plurality of plants P having leaves L. An agricultural spray apparatus 10 includes an elongated boom member 12 supported along its length by wheeled struts 14. The boom member 12 might be towed behind a tractor (not shown) or it might be part of a permanent installation (also not shown), adapted for example to move in a circular path about a central hub. The boom member 12, as seen in FIG. 2, is hollow, so as to define a manifold, and is connected, as at one end via conduit 18, to an adjustable source of pressurized air such as the centrifugal fan 16. Preferably, the fan 16 will provide a steady flow of pressurized air at a pressure of between about 10 in. and 30 in. of water column. In comparison to some prior art agricultural sprayers this may be considered to be a low pressure sprayer.

With reference to both FIGS. 1 and 2 it will be seen that the apparatus 10 also includes a source of liquid to be sprayed onto the crop, the source including a liquid container 20 provided with a pump 22 and a conduit 24 leading to a supply pipe 26 secured to the exterior of the boom member 12. The supply pipe 26 has a plurality of tees 28 spaced apart therealong, each tee being connected to a branch pipe 30 which in turn is connected to a nozzle 40 of the present invention. A plurality of the nozzles 40 is spaced apart along the length of the boom member 12 as seen in FIGS. 1 and 2.

The atomizing nozzle 40 of the present invention is described in greater detail with reference to FIGS. 3 to 6. The nozzle includes a generally cylindrical nozzle body 42 formed preferably from a resilient material such as a rubber or a synthetic formulation which will be unaffected by the liquid to be sprayed. The nozzle body 42 includes a central bore 44 having a diameter D over its length, the bore communicating at one (the inner) end with the manifold-defining interior of the boom member 12 and extending through the nozzle body 42 to an exit plane 46 at the other (the outer) end thereof. At its inner end the bore is provided with a radiused convex annular surface 48 defining a smooth entranceway to the bore 44. The surface 48 is defined by a radius r with the ratio r/D being about 0.25 and the surface 48 defined by the radius r extending over an arc of about 90°.

Figure 4:
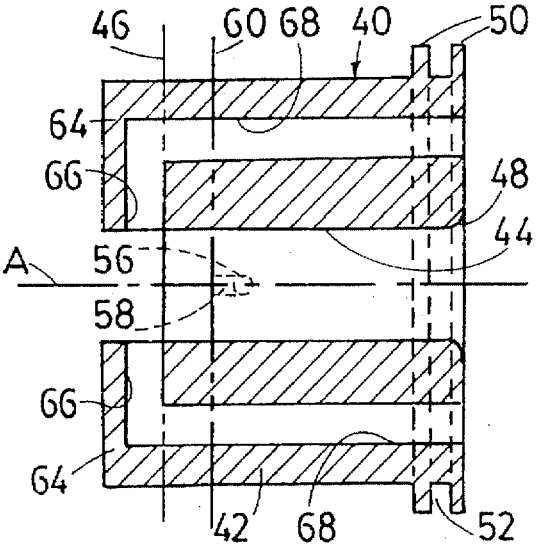
FIG. 4 is a cross-section on the line 4—4 of FIG. 3.
Figure 5:
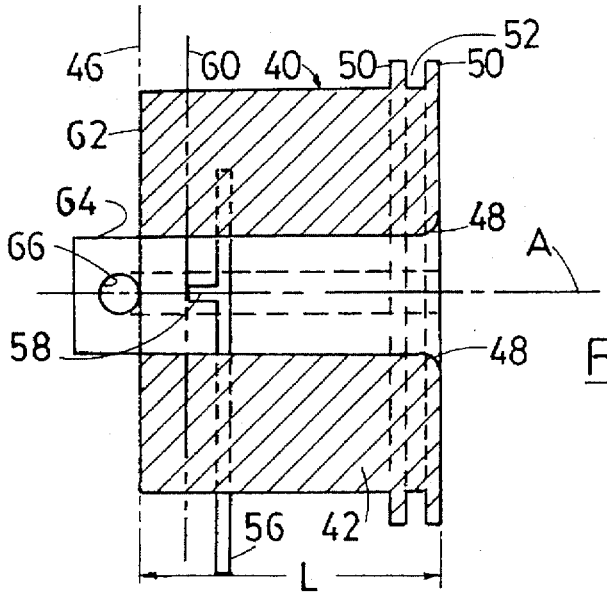
FIG. 5 is a cross-section on the line 5—5 of FIG. 3.

As shown in FIG. 4 the nozzle body 42 is provided with a pair of longitudinally spaced apart peripheral flanges 50,50 which define a narrow annular gap 52 therebetween. The nozzle body can be attached to the boom member 12 by forcing the inner flange into the interior of the boom member through an opening 54 therein so that the material of the boom member at the opening 54 is trapped in the gap 52 between the flanges 50,50. Since the boom member 12 is hollow, the manifold interior thereof is in direct communication with the central bore 44 of the nozzle body.

At the other end thereof the nozzle body receives a small diameter inlet conduit 56 which enters the body along a line at right angles to the central bore 44. The conduit 56 passes through one part of the nozzle body upstream of the exit plane 46, across the bore, and is anchored in the nozzle body on the other side of the bore. The conduit 56 has, projecting downstream therefrom, an outlet nozzle 58 which is aligned with the longitudinal axis A of the central bore 44. The exit plane 60 of the outlet nozzle 58 is also located upstream of the exit plane 46. The inlet conduit 56 is adapted to be connected to one of the branch pipes 30 that in turn is connected back to the source of liquid to be sprayed. Thus, the liquid to be sprayed will be supplied to the outlet nozzle 58 so that it will be forced into the central bore 44 in the region defined between the exit plane 60 and the exit plane 46.

On the outer face 62 of the nozzle body 42 there is provided a pair of diametrically opposed extensions or bosses 64, each having a shaping nozzle 66 in the form of a small diameter bore therein. The nozzles 66 are aligned with each other and extend orthogonally to both the axis of the central bore 44 and the inlet conduit 56. The end face of each extension is substantially tangential to the periphery of the central bore 44 and the nozzles 66 are positioned in the extensions so that the adjacent portion of the interior surface thereof is generally in the exit plane 46. Each shaping nozzle 66 is, in turn, connected to a longitudinally extending secondary bore 68 that communicates the shaping nozzle with the manifold interior of the boom member 12. Thus, each shaping nozzle will be supplied with air at the same pressure as the air that is supplied to the central bore 44. The secondary bores 68 are preferably parallel to the central bore 44 but it is not essential that they be so oriented.

Figure 6:
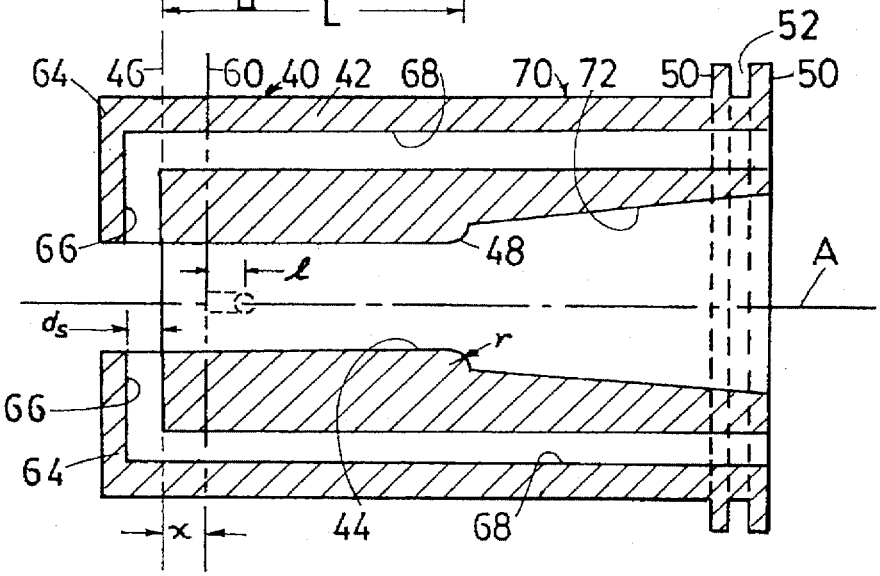
FIG. 6 is a cross-section similar to that of FIG. 4 but with a mounting extension incorporated into the nozzle body.

In its preferred form the nozzle body 42 has an extension 70 at the inner end thereof, the extension carrying the peripheral flanges 50,50 that enable the nozzle body to be connected to the boom member 12. The extension 70 includes a tapered internal bore 72, with the taper being in the vicinity of 14°. As can be seen in FIG. 6 the tapered bore 72 terminates at the entranceway defined by the surface 48 such that the convex surface is exposed to incoming air from the tapered bore 72.

It has been determined that optimum spray conditions are achieved if the dimensions and layout of the nozzle body meet certain criteria, including the one pertaining to the entranceway surface 48 as indicated hereinabove. In the definitions below the following dimensions are utilized:

D=diameter of the central bore 44;

L=length of the central bore 44;

x=distance of exit plane 60 upstream of exit plane 46;

l=distance of axis of conduit 56 upstream of exit plane 60;

$d_o$=outside diameter of conduit 56;

$d_i$=internal diameter of conduit 56;

$d_s$=internal diameter of shaping nozzle 66;

$V_r$=relative velocity between the air and the liquid;

$We_a$=aerodynamic Weber number.

The aerodynamic Weber number is used to establish the criteria for interaction of the liquid with the air stream to ensure "prompt" atomization in the central bore 44. The aerodynamic Weber number ($We_a$) dictates the conditions for atomization and is directly related to the size of droplets produced. The $We_a$ is defined with the characteristic dimension parameter as in:

$$We_a=(V_r\rho_a d_i)/\sigma_l$$

where $V_r$ and $d_i$ are as defined above, $\rho_a$ is the air density and $\sigma_l$ is the liquid surface tension.

In order to achieve optimum spray conditions and performance it is recommended that the criteria hereinbelow be met. If they are not met the present invention will still be operable but it will not provide its best performance. Thus it is recommended that:

(1) L/D be about 3 so as to achieve an air velocity within central bore 44 of about 180 ft/sec to about 300 ft/sec at the operating pressure of about 10 in. to about 30 in. of water column;

(2) x/D be about 0.25;

(3) $l/d_o$ be about 1.9 or greater;

(4) $d_i$ be selected to provide a discharge velocity for the liquid at the exit plane 60 of about 3 ft/sec to about 40 ft/sec;

(5) $d_s$ be selected to provide a ratio of mass flow of shaping air to mass flow of air in bore 44 of about 24% to about 30%;

(6) $We_a$ is at least 50, and may be as high as 175, so as to produce liquid droplets in the size range suitable for a variety of agricultural spray applications. $V_r$ is therefore typically in the range of about 145 to 280 ft/sec.

Excellent results have been achieved with a prototype nozzle having the following dimensions: L=1.750 in., D=0.578 in., x=0.150 in., l=0.140 in., $d_o$=0.072 in., $d_i$=0.053 in., and $d_s$=0.257 in.

The present invention provides a uniform spray pattern with consistent, controlled droplet size distribution within the atomized spray itself. As seen in FIG. 1 there will be overlap of the sprays from adjacent nozzles 40 at a distance below the boom member 12 of about 15 to 18 inches and the boom can be set in order to take advantage of that fact. Furthermore, the air exiting the nozzles will have sufficient force and turbulence to cause the leaves of the plants being sprayed to shake, bounce around and turn over so that the liquid can be sprayed over the complete leaf, including the underside thereof.

The FIG. 1 boom configuration assumes that the nozzles 40 are oriented so that the fan-shaped sprays overlap and are generally in a common plane. If the nozzles are rotated slightly on their central axes then the sprays will be angled relative to the boom member, while being generally parallel to each other. This orientation would provide more overlap when the boom member is moving but little or no overlap when the boom member is stationary.

The droplet size distribution achieved by the nozzle configuration of this invention remains generally constant even though the pressure within the manifold of the boom member 12 may vary, intentionally or otherwise. The droplet distribution can be shaped by the shaping nozzles 60. The combination of liquid delivery in a well-controlled internal mix environment, defined by the central bore 44, provides a prompt breakup of the liquid downstream of the outlet nozzle 58 that results in the tightly controlled droplet size distribution which can be tailored to suit the particular spray application, by choosing a nozzle having the appropriately dimensioned central bore, inlet conduit, outlet nozzle and shaping nozzle combination. Scaling of the nozzle is possible with desired and predictable spray results if the aerodynamic Weber number is maintained within the range indicated above. The configuration of the shaping nozzles and the central bore provides an environment where the droplet size distribution produced in the zone between the exit planes is not substantially affected by later aerodynamic shaping.

The foregoing has described the preferred configurations for the present invention. It is clear, however, that a skilled person could effect revisions to the present invention to suit particular applications without departing from the spirit of the invention. The protection to be afforded this invention therefore is to be determined from the claims appended hereto.

We claim:

1. A device for atomizing and spraying an agricultural liquid at low pressures comprising:

a nozzle body having an extension adapted for mounting at one end thereof to a manifold supplied with pressurized air between about 10 and 30 in. of water column;

a central bore in said nozzle body communicating at one end with said manifold and extending in a downstream direction to an exit plane at the other end, said bore having a central axis and a radiused convex annular entranceway at the one end thereof, and said extension including an internal bore which tapers inwardly from said one end of said extension to said entranceway;

an inlet conduit for said liquid, said inlet conduit extending through said nozzle body into said central bore at right angles thereto upstream of said exit plane, said inlet conduit being adapted for connection to a source of said liquid to be sprayed;

an outlet nozzle for said liquid, said outlet nozzle being aligned with said axis, extending downstream from said inlet conduit, and terminating at an exit plane located upstream of said central bore exit plane; and a pair of diametrically opposed shaping nozzles positioned downstream of said central bore exit plane and extending orthogonally to said central bore axis and to said inlet conduit, each shaping nozzle being connected to a secondary bore in said nozzle body, each secondary bore communicating the shaping nozzle with said manifold;

whereby liquid fed under pressure to said inlet conduit exits said outlet nozzle and is atomized between the exit planes of said outlet nozzle and said central bore as it is mixed with air flowing along said central bore, air exiting said opposed shaping nozzles serving to shape the atomized liquid spray into a flattened shape.

2. The device of claim 1 wherein the operating pressure of said manifold is between about 10 and 30 in. of water column.

3. The device of claim 2 wherein said central bore has a diameter D and said entranceway has a radius r, the ratio r/D being about 0.25 and the entranceway defined by the radius r being formed by an arc of about 90°.

4. A device for atomizing and spraying an agricultural liquid at low pressures comprising:

a nozzle body adapted for mounting to a manifold supplied with pressurized air between about 10 and 30 in. of water column;

a central bore in said nozzle body communicating at one end with said manifold and extending in a downstream direction to an exit plane at the other end, said bore having a central axis and a radiused convex annular entranceway at the one end thereof, an inlet conduit for said liquid, said inlet conduit extending through said nozzle body into said central bore at fight angles thereto upstream of said exit plane, said inlet conduit being adapted for connection to a source of said liquid to be sprayed;

an outlet nozzle for said liquid, said outlet nozzle being aligned with said axis, extending downstream from said inlet conduit, and terminating at an exit plane located upstream of said central bore exit plane; and a pair of diametrically opposed and aligned shaping nozzles positioned downstream of said central bore exit plane and extending orthogonally to said central bore axis and to said inlet conduit, each shaping nozzle being provided within an extension of said nozzle body adjacent said central bore exit plane and being in the form of a short cylindrical bore connected to a secondary bore in said nozzle body substantially at right angles thereto, each secondary bore communicating the shaping nozzle connected thereto with said manifold;

whereby liquid fed under pressure to said inlet conduit exits said outlet nozzle and is atomized between the exit planes of said outlet nozzle and said central bore as it is mixed with air flowing along said central bore, air exiting said opposed shaping nozzles serving to shape the atomized liquid spray into a flattened shape.

5. The device of claim 4 wherein said central bore has a length (L), with a L/D ratio of about 3 so as to achieve an air velocity within said central bore of about 180 ft/sec to about 300 ft/sec at the operating pressure of said manifold.

6. The device of claim 5 wherein the exit plane of said outlet nozzle is positioned upstream of said central bore exit plane by a distance (x) related to the bore diameter (D) by a ratio x/D of about 0.25 and the outlet nozzle exit plane is positioned relative to a central axis of said inlet conduit in accordance with a ratio $l/d_o$ of about 1.9 or greater where l is the distance between said outlet nozzle exit plane and said inlet conduit central axis and is the outside diameter of said inlet conduit.

7. The device of claim 6 wherein said inlet conduit has an internal diameter ($d_i$) selected to provide a discharge velocity for the liquid at said outlet nozzle exit plane of about 3 ft/sec to about 40 ft/sec, thereby resulting in a relative liquid to air velocity of about 145 ft/sec to about 280 ft/sec.

8. The device of claim 7 having an aerodynamic Weber number ($We_a$) for a given inlet conduit internal diameter in the range of about 50 to about 175.

9. The device of claim 8 wherein the diameter ($d_s$) of each shaping nozzle is selected to provide a ratio of mass flow of shaping air to mass flow of central bore air of about 24% to about 30%.

10. A device for atomizing a liquid at low pressures comprising:

a nozzle body adapted for mounting to a manifold supplied with air at a pressure of between about 10 and 30 in. of water column;

a central bore in said nozzle body, having a longitudinal axis, a length (L), a diameter (D), and communicating at one end with said manifold and extending in a downstream direction to an exit plane at the other end thereof, the ratio L/D being about 3 so as to achieve an air velocity at said exit plane of about 180 ft/sec to about 300 ft/sec;

an inlet conduit for said liquid, said conduit extending through said nozzle body into said bore at right angles thereto upstream of said exit plane, said inlet conduit being adapted for connection to a source of said liquid to be sprayed and having an outside diameter ($d_o$) and an internal diameter ($d_i$), said internal diameter being selected so as to provide a liquid discharge velocity of about 3 ft/sec to about 40 ft/sec;

an outlet nozzle for said liquid, said outlet nozzle being aligned with said axis, extending downstream from the axis of said inlet conduit by a distance l, and terminating at an exit plane located upstream of said central bore exit plane by a distance (x), the ratio x/D being about 0.25 and the ratio $l/d_o$ being about 1.9 or greater; and a pair of diametrically opposed shaping nozzles positioned downstream of said central bore exit plane and extending orthogonally to said central bore axis and to said inlet conduit, each shaping nozzle being connected to a secondary bore in said nozzle body, each secondary bore extending substantially parallel to said central bore and communicating the shaping nozzle with said manifold, the diameter ($d_s$) of each shaping nozzle being selected to provide a ratio of mass flow of shaping air to mass flow of central bore air of about 24% to about 30%;

whereby liquid fed under pressure to said inlet conduit exits said outlet nozzle and is atomized between the exit planes of said outlet nozzle and said central bore as it is mixed with air flowing along said central bore, air exiting said opposed shaping nozzles serving to shape the atomized liquid spray into a flattened fan shape.

11. The device of claim 10 having an aerodynamic Weber number ($We_a$) for a given inlet conduit internal diameter in the range of about 50 to about 175.

12. The device of claim 11 wherein said central bore is provided at the one end thereof with a radiused convex annular entranceway having a radius r, the ratio r/D being about 0.25 and the entranceway defined by the radius r being formed by an arc of about 90°.

13. The device of claim 12 including an extension of said nozzle body between said nozzle body and said manifold, said extension including an internal bore which tapers inwardly from said manifold to said entranceway.

14. An agricultural spraying apparatus comprising:

an elongated manifold;

means for providing air to said manifold at a pressure of about 10 to about 30 in. of water column;

means for supporting said manifold for controlled movement over an area to be sprayed;

a source of liquid to be sprayed;

pump means for pumping liquid from said liquid source at a controlled adjustable flow rate; and a plurality of spray nozzles spaced apart along said manifold, each of said nozzles comprising:

a nozzle body having an extension adapted for mounting at one end thereof to said manifold, a central bore communicating at one end with said manifold and extending in a downstream direction to an exit plane at the other end, said bore having a central axis and a radiused convex annular entranceway at the one end thereof, and said extension including an internal bore which tapers inwardly from said one end of said extension to said entranceway;

an inlet conduit connected to said liquid source, said inlet conduit extending through said nozzle body into said central bore at right angles thereto upstream of said exit plane;

an outlet nozzle for said liquid, said outlet nozzle being aligned with said axis, extending downstream from said inlet conduit, and terminating at an exit plane located upstream of said central bore exit plane; and a pair of diametrically opposed shaping nozzles positioned downstream of said central bore exit plane and extending orthogonally to said central bore axis and to said inlet conduit, each shaping nozzle being connected to a secondary bore in said nozzle body, each secondary bore communicating the shaping nozzle with said manifold;

whereby liquid fed under pressure to said inlet conduit exits said outlet nozzle and is atomized between the exit planes of said outlet nozzle and said central bore as it is mixed with air flowing along said central bore, air exiting said opposed shaping nozzles serving to shape the atomized liquid spray into a flattened shape so that there is overlap between sprays from adjacent nozzles at a predetermined distance from said manifold.

15. The device of claim 14 wherein said central bore has a diameter D and said entranceway has a radius r, the ratio r/D being about 0.25 and the entranceway defined by the radius r being formed by an arc of about 90°.

16. The apparatus of claim 14 wherein said nozzle body and said extension thereof are formed of a resilient material, selected to be unaffected by the liquid to be sprayed, said extension including a pair of spaced apart peripheral flanges at an inner end thereof for mounting said nozzle body to an opening in said manifold.

* * * * *